US005143300A

United States Patent [19]

Cutler

[11] Patent Number: 5,143,300

[45] Date of Patent: Sep. 1, 1992

[54] SHOWERHEAD

[76] Inventor: William Cutler, 230 Rte. 206, Bldg. #2, Flanders, N.J. 07836

[21] Appl. No.: 547,051

[22] Filed: Jul. 2, 1990

[51] Int. Cl.[5] ..... B05B 1/18

[52] U.S. Cl. ..... 239/562; 239/586; 239/590.3

[58] Field of Search ..... 239/586, 589, 282, 562, 239/567, 288.5, 590.3, 596

[56] References Cited

U.S. PATENT DOCUMENTS

| | | | |
|---|---|---|---|
| 2,643,104 | 6/1953 | Holden | 239/590.3 |
| 4,191,332 | 3/1980 | De Langis et al. | 239/586 |
| 4,568,027 | 2/1986 | Lazarus | 239/590.3 |
| 4,591,098 | 5/1986 | Ridenour | 239/586 |

*Primary Examiner*—Andres Kashnikow
*Assistant Examiner*—Karen B. Merritt
*Attorney, Agent, or Firm*—Ezra Sutton

[57] ABSTRACT

A showerhead having a water-pressure regulator in the form of a presettable pin and a one-piece, cup-shaped member disposed in the nozzle for controlling the fluid spray.

8 Claims, 3 Drawing Sheets

SHOWERHEAD

FIELD OF THE INVENTION

The present invention relates to a showerhead which includes a device to make the showerhead operate in a quiet, non-aerating manner, and which includes a water-pressure regulator to control the amount and pressure of the water emitted from the showerhead.

BACKGROUND OF THE INVENTION

The prior art showerheads do not include a water-pressure regulator in the form of a presettable pin or a one-piece, cup-shaped member disposed in the nozzle for controlling the fluid spray.

It is an object of the present invention to provide a showerhead which accomplishes the foregoing.

SUMMARY OF THE INVENTION

In accordance with the principles of the present invention, there is provided a showerhead for attachment to a fluid supply; a nozzle having an inlet end connected to the fluid supply and an outlet end; a cylindrical cup-shaped member disposed in said nozzle and having an open end in fluid communication with the water supply and another end having a circular disc section with spray-forming holes formed therein. The showerhead also includes a water-pressure regulator having a movable pin movable relative to the nozzle to restrict the flow of water through the nozzle as the pin is moved in one direction, and to increase the flow of water through the nozzle as the pin is moved in the opposite direction.

BRIEF DESCRIPTION OF THE DRAWINGS

Further objects, features, and advantages of the present invention will become apparent upon the consideration of the following detailed description of the presently-preferred embodiment when taken in conjunction with the accompanying drawings, wherein.

DETAILED DESCRIPTION OF THE PREFERRED EMBODIMENTS

Figure 1:
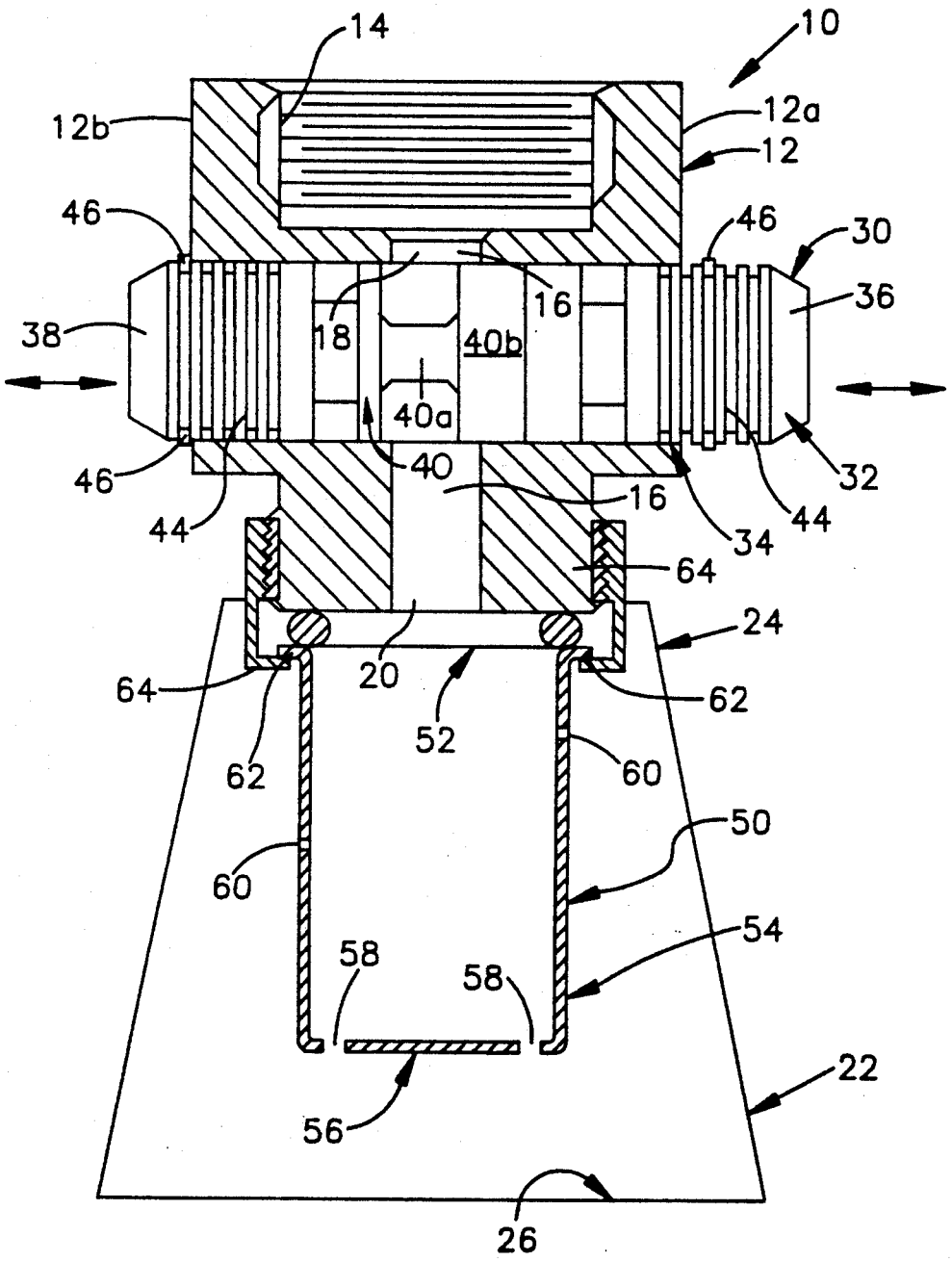
FIG. 1 is a cross-sectional view of the showerhead with the pressure regulator pin in one position.

The showerhead 10 of the present invention includes an annular member 12 for attaching the showerhead to a water pipe (not shown) or fluid supply. Annular member 12 includes an internally-threaded section 14 for connection to the fluid supply. The annular member 12 further includes a fluid channel 16 having an inlet port 18 and an outlet port 20. A nozzle 22 is threadably connected to member 12 and has an inlet end 24 and an outlet end 26.

In one embodiment, the fluid channel 16 has a water-pressure regulator 30 movably mounted therein, which includes a movable pin 32, movable in a cylindrical channel 34, for controlling the flow of fluid through fluid channel 16 and nozzle 22.

The movable pin 32 has end sections 36 and 38 and a mid-section 40 having a reduced diameter section at **40*a* and a restrictor at 40*b* having a full diameter relative to channel 34. Pin 32 has a plurality of grooves 44 on each end and selector rings 46 disposed in grooves 44. A detent may be used in place of selector rings 46**.

Figure 2:
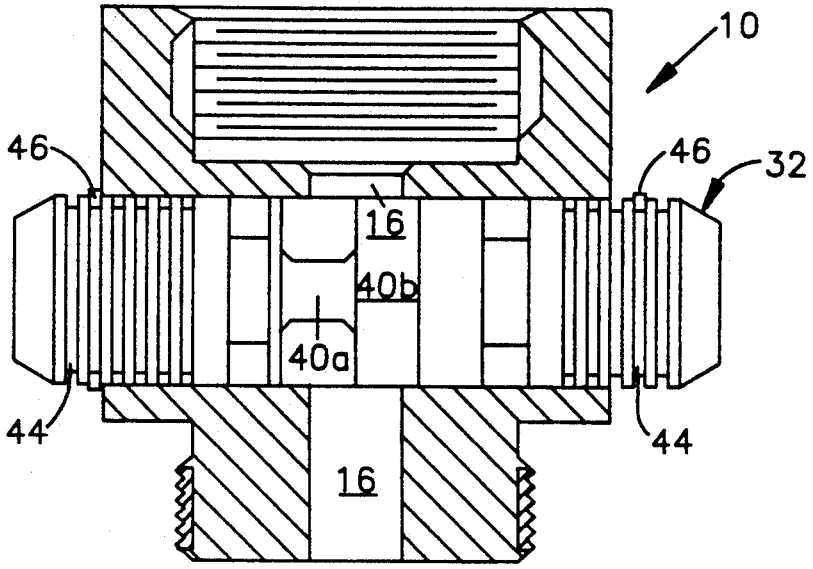
FIG. 2 is a cross-sectional view of the showerhead with the pressure regulator pin in a second position.
Figure 3:
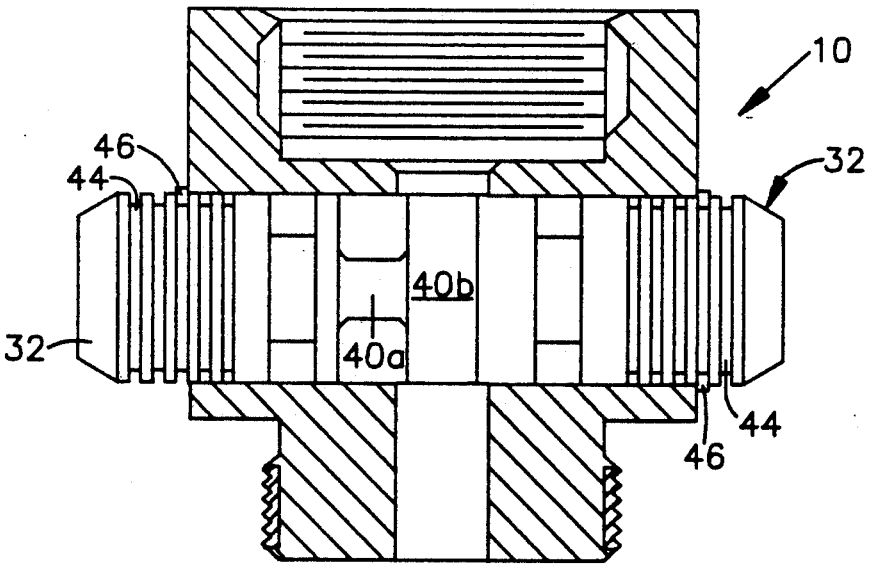
FIG. 3 is a cross-sectional view of the showerhead with the pressure regulator in a third position.
Figure 4:
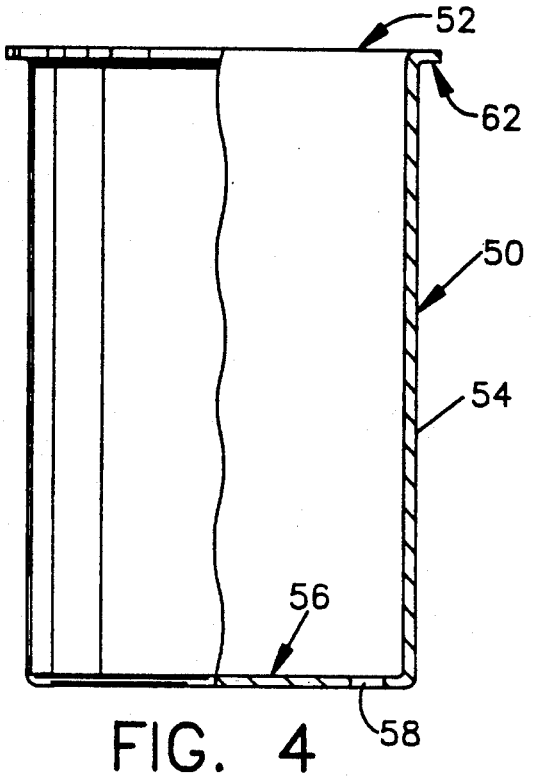
FIG. 4 is a cross-sectional view of the cup-shaped member.
Figure 5:
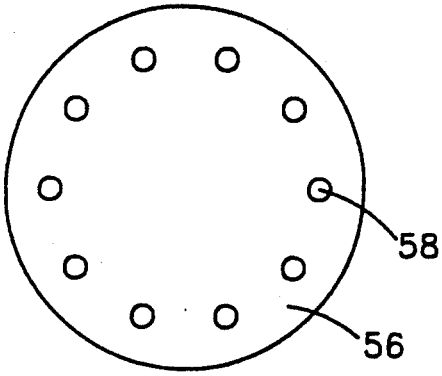
FIG. 5 is a plan view of the disc portion of the cup-shaped member.

Pin 32 is movable into different positions for controlling fluid flow. To select and preset the maximum flow position shown in FIG. 1, selector ring 46 is placed in left-most groove 44, and all of reduced section **40*a* is disposed within fluid channel 16, which allows the maximum amount of fluid or water to flow through channel 16. For example, this maximum position typically allows 2.2 gallons of water per minute to flow at a pressure of 70 psi. In an intermediate flow position shown in FIG. 2, selector ring 46 is placed in a different groove 44, and only a portion of reduced section 40*a* is disposed within fluid channel 16, which reduces the amount of water which flows through channel 16. For example, in this intermediate position of movable pin 32, 1.6 gallons of water per minute will flow at 60 psi. In the minimum flow position shown in FIG. 3, selector ring 46 is shown placed in a groove 44, and only a minimum portion of reduced section 40*a* is disposed in fluid channel 16 and allows the minimum amount of water to flow through channel 16**. For example, this minimum position typically allows only 0.8 gallon of water per minute to flow at a pressure of 40 psi.

As will be understood, the desired groove 44 is selected on either end of pin 32, and retainer ring 46 is preset into the selected groove. Then pin 32 is moved horizontally, so that the preset retainer ring 46 (or detent) engages either surface **12*a* or 12*b*, as shown in the drawings. Thus, by moving pin 32 relative to nozzle 22**, the amount of water saved can be adjusted and maximized.

An integral and cylindrical cup-shaped member 50 having an open end 52 in fluid communication with fluid channels 16 and 20 is disposed in nozzle 22. Cup-shaped member 50 is integrally formed with a cylindrical wall 54 and an end wall member or circular disc section 56, having spray-forming holes 58 formed therein. In addition, cylindrical wall 54 may have additional holes 60 formed therein. Cup-shaped member 50 includes an annular lip 62 for engagement with surface 64 on the inside of nozzle 22.

Since cup-shaped member 50 is an integral unit, it can be installed into conventional showerheads to change their spray pattern and to make them quiet and non-aerating showerheads. However, when holes 60 are utilized, the showerhead is changed to the aerating type.

Figure 6:
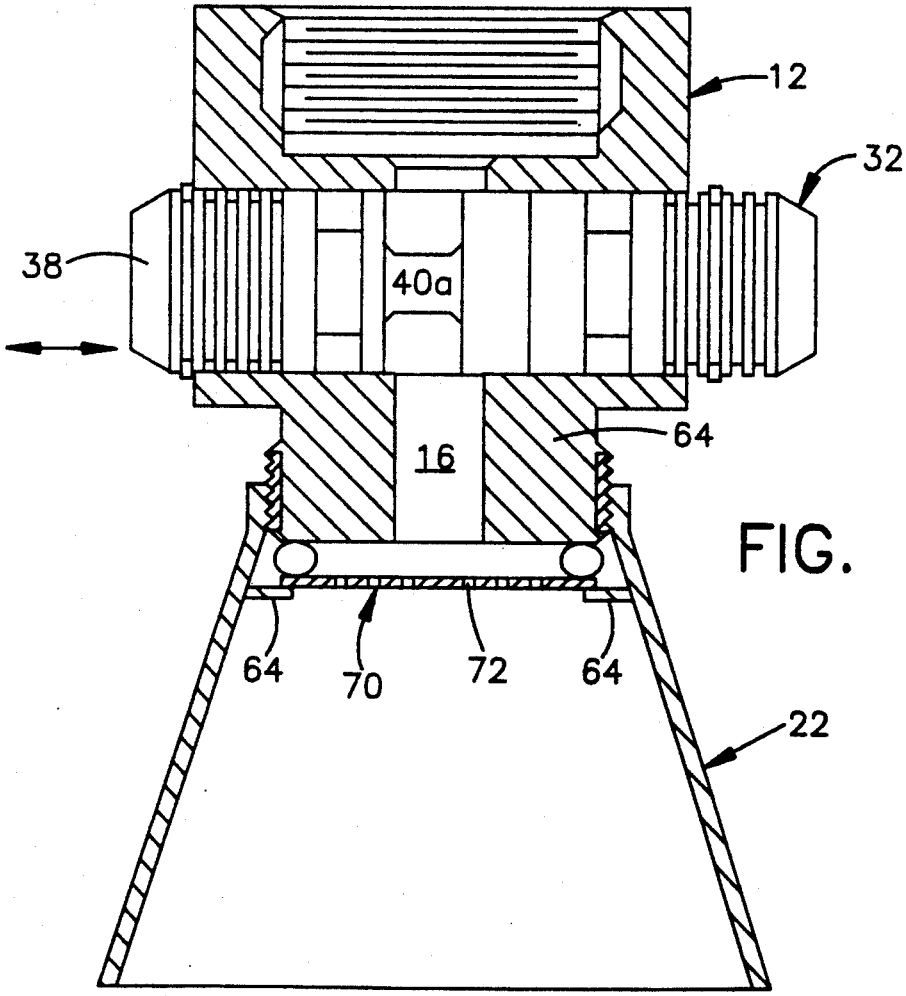
FIG. 6 is a cross-sectional view of the showerhead with the water pressure regulator and a conventional spray disc.

Referring to FIG. 6, the pressure regulator pin 32 is shown used in conjunction with a conventional spray disc 70 having spray holes 72, instead of with cup-shaped member 50. It should be understood that in accordance with the present invention, spray disc 70 may be replaced with integral cup-shaped member 50, depending on the desired use of the showerhead.

Advantageously, &here has been provided in accordance with the present invention an integral, cup-shaped member 50 which can be easily placed into a conventional showerhead to change its spray pattern and to make it quiet, non-aerating, and pulsating with a strong spray, even when the flow rate is low. Thus, it delivers less water with more force than conventional spray devices. Further, the cup-shaped member 50 can be used to refurbish a conventional showerhead when the nozzle has been improperly manufactured or machined. In addition, the present invention has provided the advantage of a movable pressure regulator pin 32 with preset selector rings that can be employed on most showerheads to preset and control water usage.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A showerhead comprising:

a) means for attaching said showerhead to a water supply;

b) a nozzle having an inner wall, and inlet end and an outlet end;

c) a one-piece and cylindrical cup-shaped member disposed in said nozzle and having a cylindrical-shaped wall spaced from the inner wall of said nozzle and having an open end in fluid communication with said water supply and another end having a circular disc section;

d) said disc section being closer to the outlet end of said nozzle than to the inlet end of said nozzle;

e) said disc section having spray-forming holes formed therein for producing a pulsating spray of water;

f) a water pressure regulator having a movable pin movable relative to said nozzle to a plurality of flow positions to restrict the flow of water as said pin is moved in one direction and to increase the flow of water as said pin is moved in the opposite direction;

g) said movable pin having means for selecting an presetting maximum and minimum flow positions; and h) having cylindrical cup-shaped member having holed in said cylindrical wall.

2. A showerhead in accordance with claim 1, wherein said means for selecting and presetting includes a plurality of grooves formed in said movable pin and selector means disposed in said grooves.

3. A showerhead in accordance with claim 2, wherein said selector means includes retainer rings.

4. A showerhead in accordance with claim 1, wherein said means for selecting and presetting includes a first groove on one end of said movable pin to select and preset a maximum flow position and a second groove on the other end of said movable pin to select and preset a minimum flow position.

5. A showerhead in accordance with claim 1, wherein said cylindrical member has a lip formed thereon to hold said member in contact with said inlet end.

6. A showerhead in accordance with claim 1, wherein said movable pin has mid-section and end sections, said mid-section being of a smaller diameter than said end sections, said mid-section being movable relative to said nozzle to change the flow of water through said nozzle.

7. A showerhead comprising:

a) means for attaching said showerhead to a water supply;

b) a nozzle having an inner wall, and inlet end and an outlet end;

c) a one-piece and cylindrical cup-shaped member disposed in said nozzle and having a cylindrical-shaped wall spaced from the inner wall of said nozzle and having an open end in fluid communication with said water supply and another end having a circular disc section;

d) said sic section being closer to the outlet end of said nozzle than to the inlet end of said nozzle;

e) said disc section having spray-forming holes formed therein for producing a pulsating spray of water; and f) said cylindrical sup-shaped member having holes in said cylindrical wall.

8. A showerhead in accordance with claim 7, wherein said cylindrical member has a lip formed thereon to hold said member in contact with said inlet end.

* * * * *

UNITED STATES PATENT AND TRADEMARK OFFICE

CERTIFICATE OF CORRECTION

PATENT NO. : 5,143,300

DATED : September 1, 1992

INVENTOR(S) : William Cutler

It is certified that error appears in the above-identified patent and that said Letters Patent is hereby corrected as shown below:

Column 2, line 62, change "&here" to --there--.

Column 3:

Claim 1, line 4, first occurrence, change "and" to --an--.

Claim 1, line 38, change "an" to --and--.

Claim 1, line 41, first occurrence, change "having" to --said--.

Claim 1, line 42, change "holed" to --holes--.

Claim 7, line 24, first occurrence, change "and" to --an--.

Claim 7, line 32, change "sic" to --disc--.

Signed and Sealed this

Seventh Day of September, 1993

Bruce Lehman

*Attest:*

BRUCE LEHMAN

*Attesting Officer*

*Commissioner of Patents and Trademarks*